US006686315B1

(12) United States Patent
Creed

(10) Patent No.: US 6,686,315 B1
(45) Date of Patent: Feb. 3, 2004

(54) SIMULATED SURFACE BUILDING MATERIALS AND PROCESS FOR MAKING THE SAME

(75) Inventor: Douglas C. Creed, Lake Wylie, SC (US)

(73) Assignee: Digital Dimensional Stone, LLC, Fort Mill, SC (US)

( * ) Notice: Subject to any disclaimer, the term of this patent is extended or adjusted under 35 U.S.C. 154(b) by 0 days.

(21) Appl. No.: 09/520,818

(22) Filed: Mar. 8, 2000

(51) Int. Cl.[7] ..... B41M 5/035; B41M 5/38
(52) U.S. Cl. ..... 503/227; 428/15
(58) Field of Search ..... 8/471; 503/227; 428/914, 15

(56) References Cited

U.S. PATENT DOCUMENTS

| | | | | |
|---|---|---|---|---|
| 4,021,591 A | | 5/1977 | DeVries et al. | 428/200 |
| 4,202,663 A | | 5/1980 | Haigh et al. | 8/471 |
| 4,354,851 A | * | 10/1982 | Hix et al. | 8/471 |
| 4,567,114 A | | 1/1986 | Oshima et al. | 428/480 |
| 4,614,521 A | | 9/1986 | Niwa et al. | 8/471 |
| 4,619,665 A | | 10/1986 | Sideman et al. | 8/402 |
| 4,626,256 A | | 12/1986 | Kawasaki et al. | 8/471 |
| 4,639,751 A | | 1/1987 | Mori et al. | 346/227 |
| 4,902,670 A | | 2/1990 | Kanto et al. | 503/227 |
| 4,923,848 A | * | 5/1990 | Akada et al. | 503/227 |
| 5,019,550 A | | 5/1991 | Suzuki et al. | 503/227 |
| 5,049,538 A | | 9/1991 | Mochizuki et al. | 503/227 |
| 5,160,505 A | | 11/1992 | Seveno et al. | 8/471 |
| 5,369,079 A | | 11/1994 | Higuchi et al. | 503/227 |
| 5,480,701 A | | 1/1996 | Hiroi | 428/204 |
| 5,522,317 A | | 6/1996 | Hale et al. | 101/488 |
| 5,555,813 A | | 9/1996 | Hale et al. | 101/492 |
| 5,601,023 A | | 2/1997 | Hale et al. | 101/488 |
| 5,644,988 A | | 7/1997 | Xu et al. | 101/488 |
| 5,693,395 A | | 12/1997 | Wine | 428/49 |
| 5,698,018 A | | 12/1997 | Bishop et al. | 106/31.75 |
| 5,746,816 A | | 5/1998 | Xu | 106/31.25 |
| 5,750,239 A | | 5/1998 | Fratello et al. | 428/195 |
| 5,891,552 A | | 4/1999 | Lu et al. | 428/195 |
| 5,916,843 A | | 6/1999 | Weller | 503/227 |
| 5,948,728 A | | 9/1999 | Patton et al. | 503/227 |
| 5,955,204 A | | 9/1999 | Yamamoto et al. | 428/500 |
| 6,028,028 A | * | 2/2000 | Nitta | 503/200 |

OTHER PUBLICATIONS

Copy of article from *Laminating Design & Technology* magazine, Source Book 2000; Nov./Dec. 1999 issue; pp. 14–19.

* cited by examiner

*Primary Examiner*—Bruce H. Hess
(74) *Attorney, Agent, or Firm*—Womble Carlyle Sandridge & Rice, PLLC; C. Robert Rhodes

(57) ABSTRACT

The present invention solves these needs by providing a building product, and a process for making the building product, that simulates the look of wood, marble, granite or other stone. The product is created by transferring a high-resolution image to a coated substrate using sublimation printing techniques. High-resolution, digital images are taken of a natural surface. These images are used to create an image on a transfer paper using sublimation inks. Building panels such as masonite, hardboard, medium density fiberboard, fiber-reinforced plastics, or cementboard, are provided with a polyester epoxy acrylate coating, or equivalent substrate capable of receiving sublimable inks. The transfer paper with the printed image is placed face-down on the substrate of the building panel. The transfer paper is pressed against the substrate and heated for a time sufficient to gasify the sublimable inks. The gasification causes the image to transfer into the image-receiving substrate. Because the ink is transferred throughout the substrate, the high-resolution image is retained with depth and richness.

The transferred image may include additional text or graphics that transfer into the image-receiving substrate to form a building material simulating a natural surface, with integral text and graphics. Further, the image-receiving substrate may provide various sheens, as desired.

22 Claims, 6 Drawing Sheets

SIMULATED SURFACE BUILDING MATERIALS AND PROCESS FOR MAKING THE SAME

FEILD OF THE INVENTION

The present invention relates to building materials, and in particular, to building materials having a simulated surface.

BACKGROUND OF THE INVENTION

Throughout time, buildings have been finished with decorative woods, granite, marble and other polished stone surfaces. Given the ever-escalating price associated with using these materials in construction, their commercial uses are traditionally limited to lobbies, entranceways, elevators and wainscoting in offices, showrooms, and other retail establishments. Residential use is further limited to fireplace surrounds, and as an elegant way to frame doorways and windows. As with many expensive building materials, numerous attempts to simulate the appearance of these materials have been made.

The most prevalent simulation technique includes laminating a representation of the surface to be simulated. Laminating essentially involves attaching paper having the simulated image to a rigid board, such as particle board. A polymeric coating is applied over the surface carrying the image to protect the image. Although laminates constructed to simulate natural surfaces have been successful, the quality of these laminates regulate their use to lower-end environments because of their inability to closely simulate the real surface. One of the primary reasons that laminates fail to provide adequate simulations is the noticeable lack of depth when viewing the two-dimensional, printed images. Further, the inks used to provide the laminated image are prone to separate and yield an artificial-looking print.

In many commercial environments, these natural surfaces are attached to lettering, logos and crests. Currently, these additions are separately formed from natural or man-made materials and affixed to the natural surface to create the lettering, logo or crest. This process is expensive and time-consuming, especially when metallic, such as gold, additions are required.

Further, natural surfaces are often bulky, inconsistent in shape and size, and difficult to shape. These materials are prone to chipping and breaking, which increase the cost and labor associated with installation.

Given the expense associated with up-fitting buildings with natural surfaces and the void of simulated alternatives, there is a need for a simulated surface that substantially replicates a natural surface to a degree allowing substitution in high-end building environments. There is also a need to easily provide lettering and graphics on these surfaces. Further yet, there is a need for a high-end simulated surface on a medium that allows easy cutting and shaping for installation.

SUMMARY OF THE INVENTION

The present invention solves these needs by providing a building product, and a process for making the building product, that simulates the look of wood, marble, granite or other stone. The product is created by transferring a high-resolution image to a coated substrate using sublimation printing techniques. High-resolution, digital images are taken of a natural surface. These images are used to create an image on a transfer paper using sublimation inks. Building panels such as masonite, hardboard, medium density fiberboard, fiber-reinforced plastics, or cementboard, are provided with a polyester epoxy acrylate coating, or equivalent substrate capable of receiving sublimable inks. The transfer paper with the printed image is placed face-down on the substrate of the building panel. The transfer paper is pressed against the substrate and heated for a time sufficient to gasify the sublimable inks. The gasification causes the image to transfer into the image-receiving substrate. Because the ink is transferred throughout the substrate, the high-resolution image is retained with depth and richness.

The transferred image may include additional text or graphics that transfer into the image-receiving substrate to form a building material simulating a natural surface, with integral text and graphics. Further, the image-receiving substrate may provide various sheens, as desired.

These and other aspects of the present invention will become apparent to those skilled in the art after a reading of the following description of the preferred embodiment when considered with the drawings.

DETAILED DESCRIPTION OF THE PREFERRED EMBODIMENT

The present invention uses sublimation printing techniques to transfer an image of a natural building surface onto a substrate, which covers the surface of a building material. The resultant building material is used to cover walls and provide other building surfaces to provide a high-performance replication of a natural building material, such as wood, marble, granite or limestone.

Sublimation printing techniques have been employed in the textile industry for years and involve the printing of a design on a paper backing sheet, or release medium, by conventional printing techniques employing sublimation inks. The design is then transferred from the release medium under heat and pressure to a receiving medium, which has traditionally been cloth or fabric. The sublimation inks, although somewhat dull and off-color when printed on the release medium, produce brilliant colors and clear designs when transferred under heat and pressure. The resultant images are capable of a full range of colors and have continuous gradation between these colors. The images are comparable to color photographs.

Generally, the release medium includes a substrate film, such as a polyester film, which has a sublimable ink-containing ink layer on one side and a heat-resistant layer on the other side to prevent sticking to a heat source. The ink layer of the release medium is overlaid on an image-receiving substrate formed of a polyester resin or equivalent substrate. Heat is applied to the backside of the release medium in an image-wise manner, so that the sublimable ink migrates from the ink layer of the release medium onto the image-receiving substrate, to form the desired image. Notably, the sublimable ink penetrates the image-receiving substrate, and does not simply reside on the surface of the substrate. In essence, during transfer, the sublimable ink transfers from a solid to a gas to integrate with the image-receiving substrate. Since the image transfers throughout the image-receiving substrate, the image is deep and maintains richness and resolution.

Figure 1:
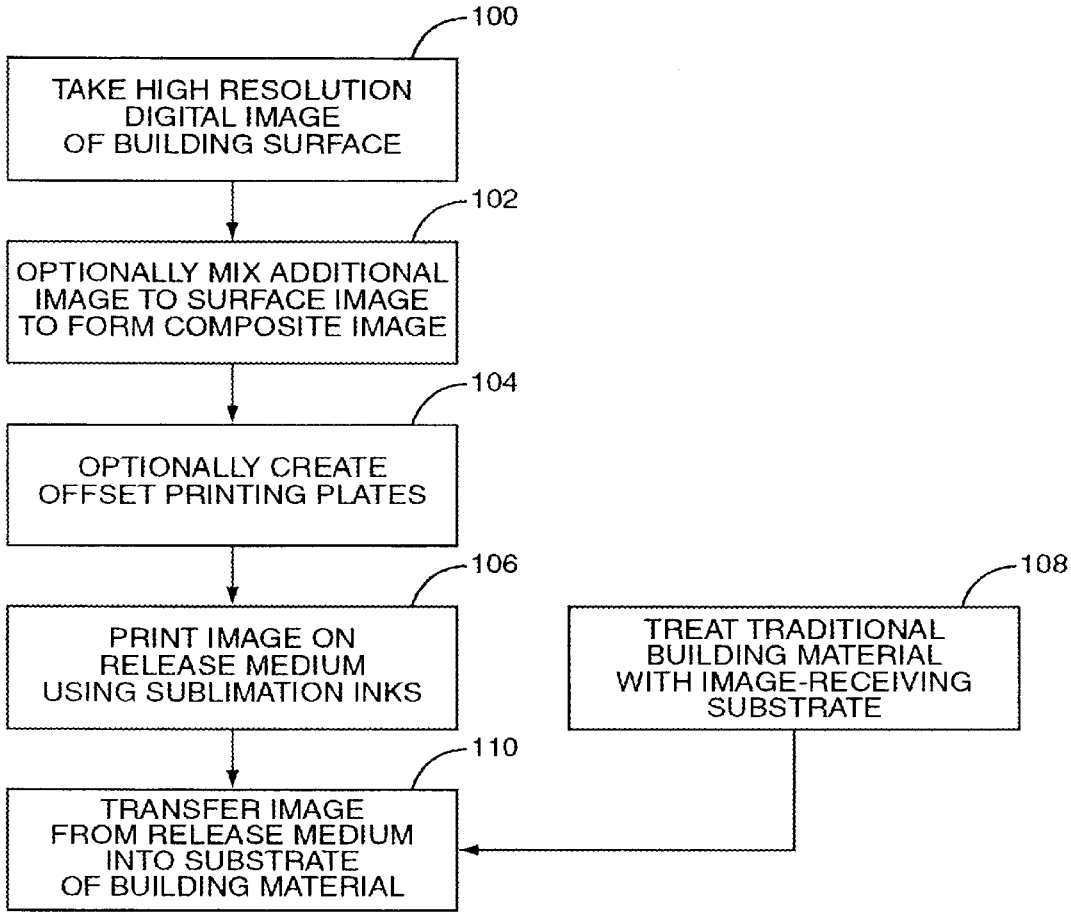
FIG. 1 depicts the process flow for making the simulated surface building materials of the present invention.
Figure 2:
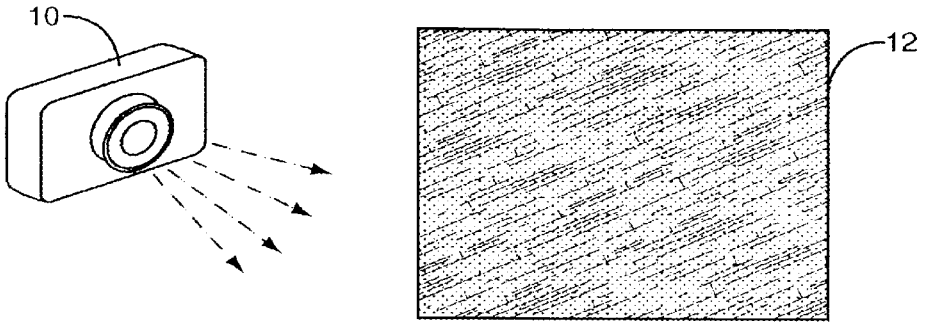
FIG. 2 depicts an imaging process according to the present invention.
Figure 3:
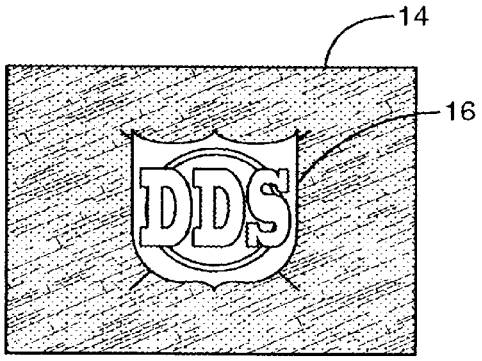
FIG. 3 represents a composite image of a natural surface with optional graphics according to the present invention.

The preferred process for creating high resolution, simulated finishes is outlined in FIG. 1, in association with FIGS. 2–7. The process begins by taking a high-resolution digital image of a desired building surface, such as marble, granite or limestone (Block 100). Preferably, a digital camera 10 is used to take an image of an actual natural surface 12, as shown in FIG. 2. The high-resolution image of the building surface may be mixed with optional text or graphics to form a composite image (Block 102). For example, a crest 16 may be added to the surface image 14, as shown in FIG. 3.

Once the desired image is obtained, it is preferable to create off-set printing plates (Block 104) capable of printing the image using sublimable inks. Off-set printing plates 18 are separate plates, each having a dedicated primary color which, when combined during the printing process, are capable of printing full color images. Off-set printing is well-known in the art.

Figure 4:
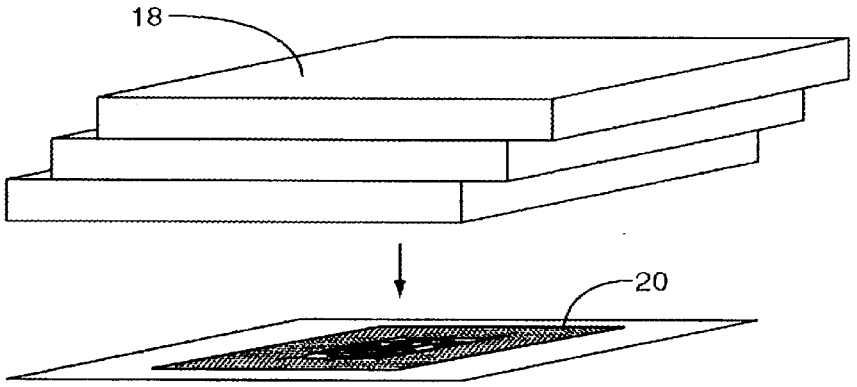
FIG. 4 illustrates the use of off-set printing plates to form an image on a transfer medium according to the present invention.
Figure 5:
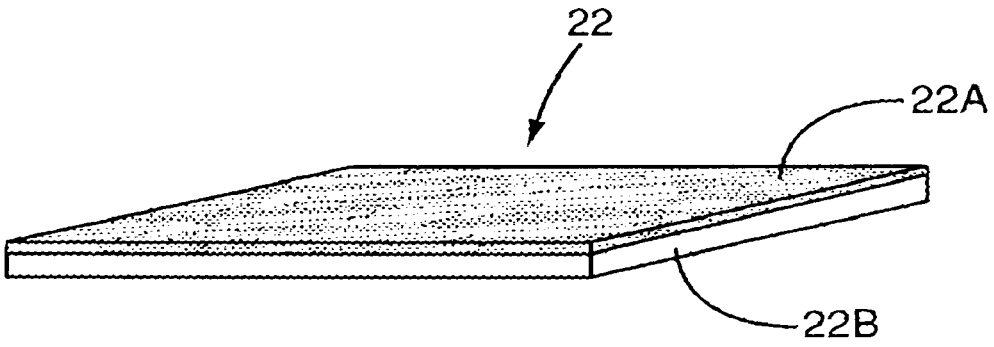
FIG. 5 is a perspective representation of a blank building medium according to the present invention.

Using sublimation inks, the image is printed on a release medium 20 (Block 106), typically a heat transfer sheet, which is a heat-resistant paper, as shown in FIG. 4. Subsequently, the release medium 20 is placed image-down against a building material 22. The building material is preferably made of a traditional sheet material 22B having a surface covered with an image-receiving substrate 22A, as seen in FIG. 5 (Block 108). This traditional sheet material typically includes masonite, hardboard, medium-density fiberboard, fiber-reinforced plastic, or cementboard. The image-receiving substrate is preferably polyester epoxy acrylate, but may be any polymeric substrate capable of receiving sublimable inks. When the image-receiving substrate 22A is a polyester epoxy acrylate, the substrate is approximately seven mils thick.

Figure 6:
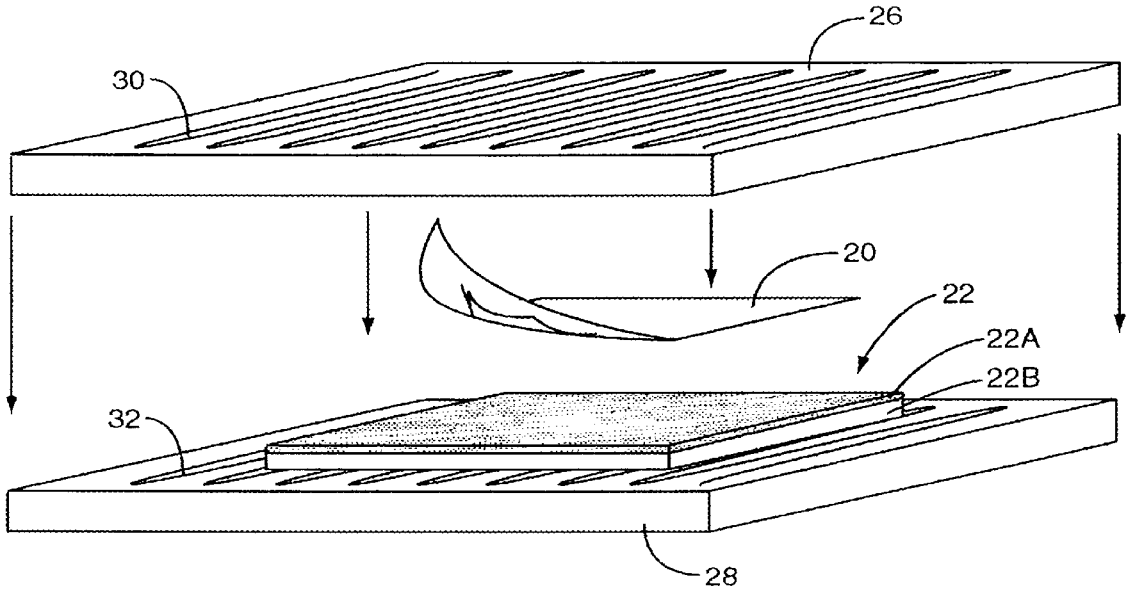
FIG. 6 illustrates a heat-transfer platen used to transfer the image on the transfer medium to the blank building medium according to the present invention.

The image is transferred from the release medium 20 to the image-receiving substrate 22A (Block 110) using platens 26, 28, as shown in FIG. 6. The platens 26, 28 are configured to move toward one another to press the release medium 20 against the image-receiving substrate 22 during image transfer. The platen 26 includes a heating element 30 configured to supply heat to the release medium 20 and image-receiving substrate 22. The lower platen 28 may also include a heating element 32 to provide additional, and more thorough, heating of the building material 22 and image-receiving substrate 22A. The pressure and temperature provided by the platens 26, 28 depend on the sublimation inks, transfer medium 20, and image-receiving substrate 22A of the building material 22. Additional detail regarding sublimation printing is provided and incorporated by reference from the following patents: U.S. Pat. No. 5,369, 079 to Higuchi et al.; U.S. Pat. No. 4,202,663 to Haigh et al.; U.S. Pat. No. 4,021,591 to DeVries et al.; U.S. Pat. No. 5,644,988 to Xu et al.; and U.S. Pat. No. 4,567,114 to Oshima et al.

Figure 7:
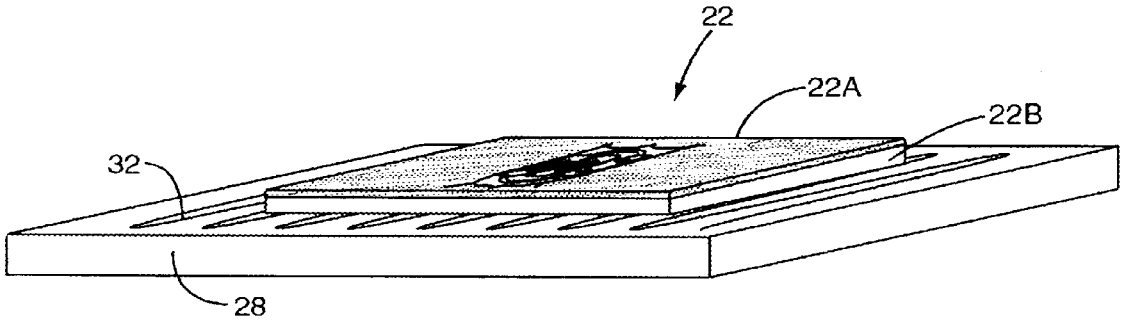
FIG. 7 depicts the building medium having the transferred image according to the present invention.
Figure 8:
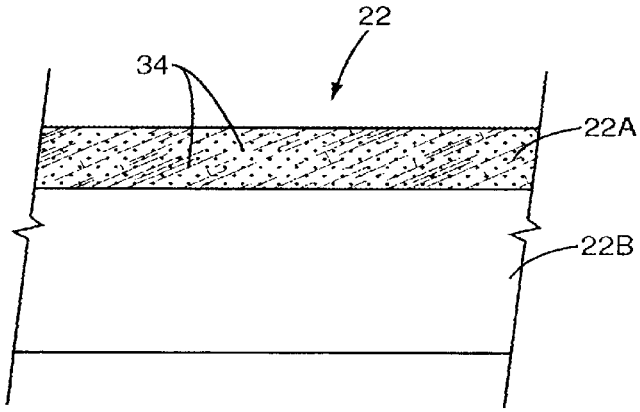
FIG. 8 is a cross-sectional view of the building medium having the transferred image.

As shown in FIGS. 7 and 8, the image is transferred into, and not just on, the image-receiving substrate 22A. Notably, the ink 34 transfers throughout the image-receiving substrate 22A, which results in a deep, rich, full-color image of the natural surface image, and any optional text or graphics provided in the transferred image.

Figure 9:
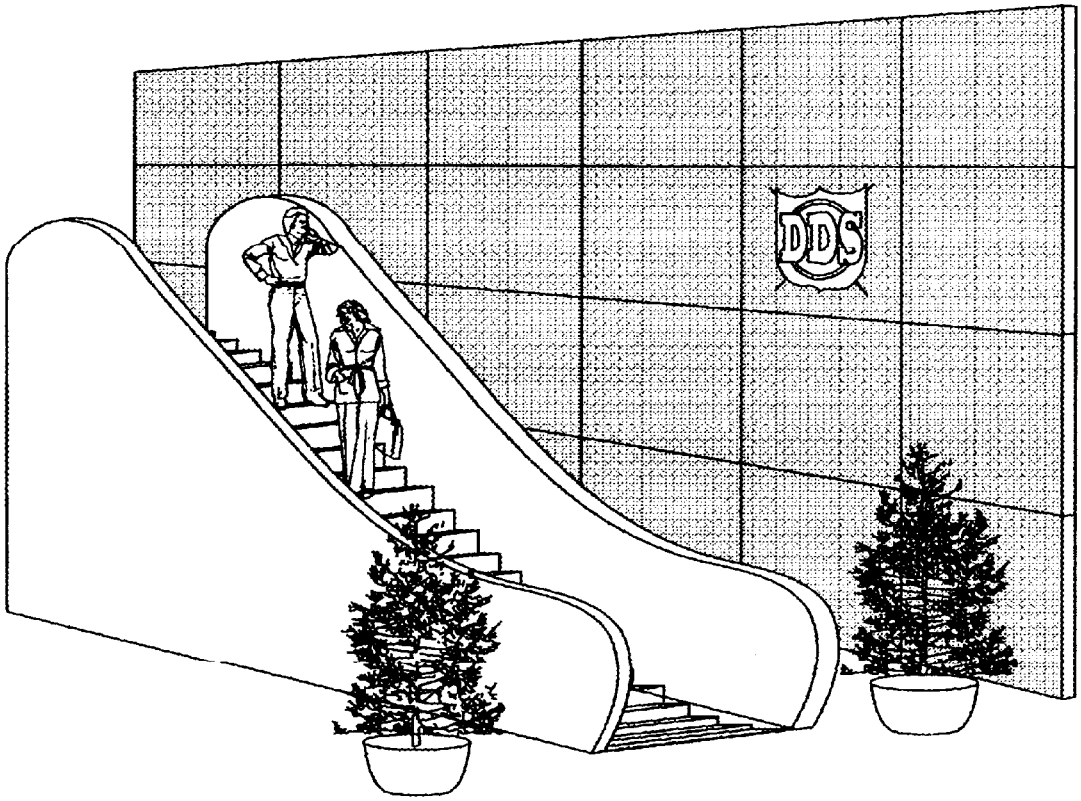
FIG. 9 is a perspective representation of a building interior covered with the simulated building medium of the present invention.

FIG. 9 depicts an exemplary building construction wherein large panels made of building material 22 cover a wall in a commercial building. Preferably, the image-receiving substrate may provide any number of sheens, such as flat, satin and high-gloss finishes. Regardless of sheen, the replication is true and to a high-performance furniture-quality finish.

The description above describes the preferred embodiments of the present invention. Based on these teachings, those skilled in the art will recognize modifications to these embodiments. All such modifications are considered within the scope of the present invention and the claims that follow.

What is claimed is:

1. A method for forming a simulated, natural surface on a building material, said method comprising:

a. providing a building material having a surface coated with an image receiving substrate for receiving sublimable inks;

b. taking a high-resolution image of a surface of a natural material used to finish buildings;

c. printing the image on a release medium using sublimable inks to form sublimable image;

d. transferring the sublimable image from the release medium into the image receiving substrate of the building material.

2. The method of claim 1 further comprising the step of mixing an additional image with the high-resolution image to form the image printed on the release medium and transferred to the image receiving substrate.

3. The method of claim 1 further comprising the steps of creating offset printing plates for printing the image on the release medium using the sublimable inks.

4. The method of claim 1 wherein the transferring step includes placing a surface containing the image of the release medium face down against the image receiving substrate of the building material, pressing the release medium against the image receiving substrate, and heating the release medium and image receiving substrate sufficiently to effect transfer of the sublimable inks from the release medium into the image receiving substrate.

5. The method of claim 1 wherein the providing step further comprises coating the surface of a building material with the image receiving substrate.

6. The method of claim 1 wherein the image receiving substrate is a polyester.

7. A building material having a simulated image of a natural surface transferred into an image receiving substrate using the sublimation printing and transfer process of claim 1 wherein the image receiving substrate is polyester epoxy acrylate.

8. The method of claim 1 further comprising the step of cutting the building material into a desired shape for installation.

9. The method of claim 1 further comprising the step of installing the building material to form a finished interior surface of a building.

10. The method of claim 1 further comprising the step of installing the building material on a vertical wall to form a finished surface.

11. The method of claim 1 wherein the taking step includes taking an image of a surface of one of the group consisting of marble, granite, and stone.

12. The method of claim 1 wherein the building material is one of the group consisting of masonite, hardboard, medium-density fiberboard, cement board and fiber-reinforced plastic.

13. The method of claim 1 wherein the release medium is a heat transfer paper adapted to receive a printed image formed using sublimable inks.

14. A building material having a simulated image of a natural surface transferred into an image receiving substrate using the sublimation printing and transfer process of claim 1, wherein the image receiving substrate is polyester epoxy acrylate.

15. The building material of claim 14 wherein the image receiving substrate is around about seven thousandths of an inch thick.

16. A method for forming a simulated, natural surface on a building material, said method comprising:

a. providing a building material having a surface coated with an image receiving substrate for receiving sublimable inks;

b. taking a high-resolution image of a surface of a natural material used to finish buildings;

c. printing the image on a release medium using sublimable inks to form sublimable image;

d. transferring the sublimable image from the release medium into the image receiving substrate of the building material by:

e. placing a surface containing the image of the release medium face down against the image receiving substrate of the building material;

f. pressing the release medium against the image receiving substrate; and g. heating the release medium and image receiving substrate sufficiently to effect transfer of the sublimable inks from the release medium into the image receiving substrate.

17. The method of claim 16 further comprising the step of mixing an additional image with the high-resolution image to form the image printed on the release medium and transferred to the image receiving substrate.

18. The method of claim 16 further comprising the steps of creating offset printing plates for printing the image on the release medium using the sublimable inks.

19. A building material having a simulated image of a natural surface transferred into an image receiving substrate using the sublimation printing and transfer process of claim 16, wherein the image receiving substrate is polyester epoxy acrylate.

20. A building material having a simulated surface appearance comprising:

a. a panel of building material having a first surface;

b. an image receiving substrate covering said first surface, the image receiving substrate comprising polyester epoxy acrylate; and c. said substrate penetrated throughout with sublimate inks forming a high-resolution image of a surface of a natural material used to finish buildings.

21. The building material of claim 20 wherein said high-resolution image of a surface of the natural material is mixed with an additional image to form a composite image.

22. The building material of claim 21 wherein said composite image includes at least one of the group consisting of text and graphics.

* * * * *

UNITED STATES PATENT AND TRADEMARK OFFICE

CERTIFICATE OF CORRECTION

PATENT NO. : 6,686,315 B1
DATED : February 3, 2004
INVENTOR(S) : Douglas C. Creed It is certified that error appears in the above-identified patent and that said Letters Patent is hereby corrected as shown below:

Column 4,
Lines 29 and 31, insert -- digital photographic -- before "image".
Line 32, insert -- a -- before the words "sublimable image".
Line 57, Claim 7 should read -- The method of Claim 1 wherein the image receiving substrate is a copolymer comprising polyester epoxy acrylate --.

Column 5,
Lines 27 and 29, insert -- digital photographic -- before "image".
Line 30, insert -- a -- before the words "sublimable image".

Signed and Sealed this

Twentieth Day of April, 2004

JON W. DUDAS
*Acting Director of the United States Patent and Trademark Office*